United States Patent [19]

Sutcliffe

[11] Patent Number: 4,799,904

[45] Date of Patent: Jan. 24, 1989

[54] COMPLIANT TAIL CONNECTOR

[75] Inventor: Roger F. Sutcliffe, Northport, N.Y.

[73] Assignee: Mill-Max MFg. Corp., Oyster Bay, N.Y.

[21] Appl. No.: 79,240

[22] Filed: Jul. 29, 1987

[51] Int. Cl.[4] ..... H01R 13/428

[52] U.S. Cl. ..... 439/733; 439/869

[58] Field of Search ..... 439/78, 81, 82, 84, 439/741, 743, 751, 825–827, 844, 853, 869, 870, 873, 733, 444

[56] References Cited

U.S. PATENT DOCUMENTS

| | | | |
|---|---|---|---|
| 3,621,445 | 11/1971 | Horecky et al. | 439/81 |
| 3,923,359 | 12/1975 | Newsam | 439/75 |
| 4,050,772 | 9/1977 | Birnholz et al. | 439/84 |
| 4,374,607 | 2/1983 | Bright et al. | 439/825 |
| 4,596,437 | 6/1986 | Rush | 439/82 |
| 4,720,268 | 1/1988 | Weiss | 439/82 |

FOREIGN PATENT DOCUMENTS

| | | | |
|---|---|---|---|
| 1060271 | 3/1967 | United Kingdom | 439/733 |

*Primary Examiner*—Gil Weidenfeld
*Assistant Examiner*—Gary F. Paumen
*Attorney, Agent, or Firm*—David S. Woronoff

[57] ABSTRACT

An electrical connector formed from a solid material having a compliant end with a plurality of barb-like concentric rings formed about a hollow cavity formed in the material in which an axially extending channel has been formed for engaging a press fit terminal formed in a circuit board or other similar device.

20 Claims, 1 Drawing Sheet

COMPLIANT TAIL CONNECTOR

FIELD OF THE INVENTION

The present invention relates to a novel connector for use in a press-fit socket. In many electrical and electronic applications a variety of circuit elements are mounted on a circuit board of some type. These boards commonly have plated or solder coated holes on them. These plated holes are designed to receive soldered component leads. In certain instances, it is impractical to make such a soldered connection. In those instances, a solderless press fit connection is used for convenience and cost savings. Such connectors have either been formed from stamped parts or machined parts. The present invention relates to a novel machined, not stamped, electrical connector.

In the field to which the present invention relates the following factors are important: the plated through hole must be reusable if a connector is withdrawn for replacement (the connector can be discarded); the compliant tail must acomodate industry tolerance standards for plated through holes (which is plus or minus 0.003 inches for parts for certain circuit elements); the plated through hole must not be deformed (deformation of the plated through hole is likely to lead to one or more fractured layers in a multi-layer board); and, the connection formed must be gas tight. The present invention achieves all of these required goals while achieving certain important functional advantages.

SUMMARY OF THE INVENTION

The present invention relates to a novel electrical connector machined from a solid blank of conductive material by milling and drilling. Superficially it appears that similar parts can be made by stamping and folding flat metal stock. In fact such stamped parts are not functionally equivalent in all respects. An example of such a stamped part is that shown in U.S. Pat. No. 4,017,143. The important functional differences are: higher pin retention force for the same insertion force; greater pin pressures on hole side walls leading to an excellent gas tight connection; far less expensive to tool (because no dies are required) and far easier alteration of connector specifications; less expensive to produce in both small and large volumes. Probably the greatest cost advantage for these products exists in the ability to vary the product and produce it in relatively small quantities.

Prior art machined connectors of this general type were and are rigid and non-compliant. These prior art parts function by deforming and damaging the plated through hole. The non-compliant parts require plated through hole tolerances of 0.001 of an inch which is far smaller than the 0.003 of an inch tolerance permitted for compliant connectors.

DESCRIPTION

Figure 2:
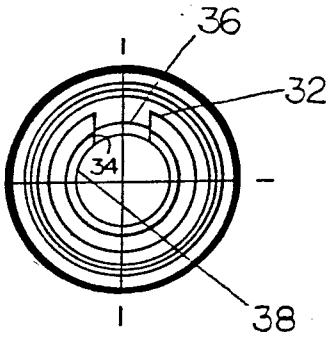
FIG. 2 shows an end view of the embodiment shown in FIG. 1.

While this invention is capable of being embodied in many different forms, there is shown in the drawings and will be described in detail, one specific embodiment with the understanding that the present disclosure is an exemplification of the principles of the invention and does not limit the invention to the embodiment illustrated.

Figure 1:
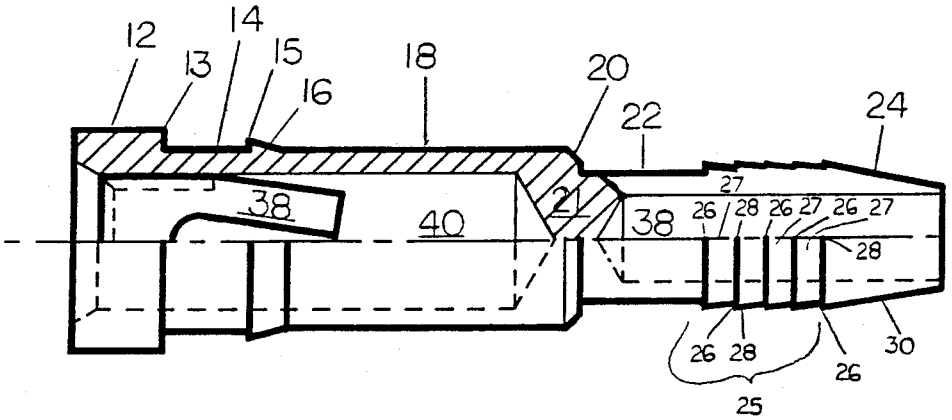
FIG. 1 shows a plan view of one embodiment of the present invention.

Turning now to FIG. 1, numeral 10 shows an electrical connector for insertion into a plated solder coated hole formed from a solid conductive material such as a copper alloy. The embodiment shown has a head 12 formed on one end. Moving axially along the part a shoulder 13 is formed by an undercut section 14. Undercut 14 leads to a barb 15 which has a tapered surface 16 which extends to the central body of the connector. Within the central section of the body is formed, typically by drilling, a cavity 40 in which a connector shown as a spring contact 38 is formed or placed. Other forms of connector could be used. The portion of the embodiment of the present invention shown thus far could be formed in many other suitable shapes such as a rectangular shape for a wire wrap connection or a round connector pin.

The cavity 40 leads to a solid bridge-like section 21, joining the head end 12 and the compliant end 24. The compliant end 24 has a cylindrical section 22 which has a smaller outer diameter than that of the larger diameter of the series of barbs which form the central section 25 of the compliant end 24. The insertion end 30 has a smaller diameter than the smallest mounting hole for which that part is intended.

The central section 24 is formed of a series of barbs having an outer diameter 26, an inner diameter 28 and a smoothly tapering section 27 joining them. FIG. 1 shows four such barbs. Each barb outer diameter is the same as is each barb inner diameter. To achieve a good, stable contact, at least two rings or barbs are required. Typically a connector for an 0.062 inch thick circuit board will have four rings; a connector 0.093 board will have six rings and for an 0.032 board will have two rings. The barbs themselves have an edge which is nominally 0.0015 of an inch wide. The plurality of barbs helps to distribute the load within the plated through hole aong the wall in an axial direction. The rings are desirably tapered to increase in diameter as the increase in distance from the insertion end. The proper direction of taper insures that the retention force is a greater percentage of the insertion force than for stamped products or for products without the proper direction of taper.

The axial extent of the rings should be smaller than the thickness of the plated through hole so that the connector can be placed centrally within the plated through hole to keep the internal stresses within the board balanced. In the balanced condition, the board will not warp.

The outer diameter of the rings should be larger than the largest mounting hole diameter. This range of difference should be of the order of 0.001 to 0.002 of an inch. The inner diameter of the rings is smaller than the outer diameter of the ring and provides one end of the ramp-like surface.

After the central section 25 is formed a smoothly inwardly tapering lead-in surface is formed. A second cavity 38 is formed in the connector by drilling it. An axial cut is formed in the compliant tail to permit the central section 24 to flex when the connector is inserted into a solder coated or plated through hole. In order to insure that the part is truly compliant the slot 26 and the cavity 38 must extend beyond the rings or barbs.

Because of the compliant section with its barbed and slotted ends a relatively wide range of holes ranging from 0.043 inches to 0.037 inches in diameter can be mated with a nominal diameter of 0.044 inches formed from a solid material by milling and drilling. In a part of this nominal size a maximum forty pound insertion force is required. This requires an upper wall thickness of about 0.006 inches in the body diameter of about 0.055 inches.

What is claimed is:

1. An electrical connector for insertion in a board mounting aperture having a coating, comprising:

an aperture engaging section having a plurality of barb like rings formed thereon;

the aperture engaging section having a cavity formed therein;

the aperture engaging section having an axially extending slot formed therein;

said aperture engaging section being forcibly and nondestructively engaged by the board mounting aperture coating such that a gas tight electrical connection is achieved without deforming the aperture coating.

2. The connector claimed in claim 1 wherein said barb like section is formed of a plurality of concentric rings having first and second diameters in which the first diameter is larger than the second diameter and in which the axially extending portion joining the first and second diameters is a smooth surface.

3. The connector claimed in claim 1 including further:

a cylindrical section formed axially above the barb like rings.

4. The connector claimed in claim 1 including further:

a tapering section formed axially below the the barb like rings.

5. The connector claimed in claim 1 including further:

a solid central section axially above the barb like rings.

6. The connector claimed in claim 1 wherein:

the aperture engaging section cavity and axially extending slot have a greater axial extent than the barb-like rings have an axial extent;

the barb-like rings axial extent is less than the thickness of the mounting aperture;

the aperture engaging section barb-like rings have first and second diameters in which one of said diameters is larger than the diameter of the mounting aperture.

7. The connector claimed in claim 1 including further:

an insertion end formed on one end of the connector for insertion into the aperture, having a smaller diameter than the outer diameter of the barb-like rings.

8. The connector claimed in claim 7 wherein:

the aperture engaging section having two or more barb-like rings.

9. The connector claimed in claim 8 wherein:

the barb-like rings have an axial extent;

the barb-like rings axial extent is smaller than the axial extent of the aperture.

10. The connector claimed in claim 9 wherein:

the barb-like rings have first and second diameters;

one of said first and second diameters is larger than the diameter of the aperture by a small amount.

11. The connector claimed in claim 10 wherein:

said slot and said cavity have an axial extent;

the axial extent of the slot and cavity exceed the axial extent of the barb-like rings.

12. The connector claimed in claim 10 wherein:

the other of said first and second diameters is smaller than the first diameter and forms the beginning of a ramp-like surface.

13. The connector claimed in claim 10 wherein:

said first and second diameters are arranged such that said second diameter is larger than the first diameter;

a smooth outer wall connects the first and second diameters;

an insertion end is formed adjacent the barb-like rings first diameter.

14. The connector claimed in claim 13 including further:

said cavity and said slot have an axial extent;

said barb-like rings have an axial extent;

the barb-like rings axial extent is less than that of said cavity and slot.

15. An electrical connector for insertion in a board mounting aperture having a diameter, axial extent and a conductive coating, comprising:

a solid blank formed into a first head end and a second compliant end;

the second compliant end having a cavity formed therein, said cavity having an outer wall;

said cavity outer wall having an axially extending slot formed therein;

said compliant end having one or more barb like rings thereon for engaging the coated aperture;

said compliant end being forcibly and non-destructively engaged by the board mounting aperture coating such that a gas tight electrical connection is achieved without deforming the aperture coating.

16. The connector claimed in claim 15 wherein:

the barb-like rings comprise one or more rings having an inner and an outer diameter joined by a smooth surface.

17. The connector claimed in claim 16 wherein:

a tapering end section is formed on one end of the connector which is the insertion end;

the barb-like rings inner diameter is adjacent the tapering end insertion section.

18. The connector claimed in claim 15 including further:

said compliant end having an insertion end;

said insertion end having a diameter smaller than the aperture.

19. An electrical connection comprising in combination:

board means having at least one aperture means formed therein;

the aperture means having an electrically conducting sidewall means;

an electrically conducting solid blank member formed into a first head end and a second compliant end;

the second compliant end having a cavity formed therein, said cavity having an outer wall;

said compliant end having one or more barb like rings formed thereon for non-destructively engaging the electrically conducting sidewall means.

20. The combination claimed in claim 19 wherein:

said electrically conducting sidewall means has a first axial extent;

said barb like rings have a second axial extent which is less than the first axial extent;

said board means has a plurality of layers of electrically conductive material contained therein.

* * * * *